US009300086B1

(12) United States Patent
Qu et al.

(10) Patent No.: US 9,300,086 B1
(45) Date of Patent: Mar. 29, 2016

(54) PORTABLE COMMUNICATION DEVICE CLIP CONNECTOR

(71) Applicant: ANRAY INT'L CORPORATION, Orange, CA (US)

(72) Inventors: Haijuan Qu, Orange, CA (US); Liren Lin, Orange, CA (US)

( * ) Notice: Subject to any disclaimer, the term of this patent is extended or adjusted under 35 U.S.C. 154(b) by 0 days.

(21) Appl. No.: 14/631,289

(22) Filed: Feb. 25, 2015

(51) Int. Cl.
*H01R 13/627* (2006.01)
*H01R 13/639* (2006.01)
*H01R 43/20* (2006.01)

(52) U.S. Cl.
CPC ..... *H01R 13/639* (2013.01); *H01R 43/20* (2013.01)

(58) Field of Classification Search
CPC ..... H01R 13/6275; H01R 13/65802
USPC ..... 439/358, 327, 353, 357, 350, 939, 567
See application file for complete search history.

(56) References Cited

U.S. PATENT DOCUMENTS

| | | | | |
|---|---|---|---|---|
| 6,884,100 | B1 * | 4/2005 | Hsiao | G06F 1/184 439/327 |
| 8,469,732 | B2 * | 6/2013 | Sen | H01R 13/639 439/347 |
| 2013/0045618 | A1 * | 2/2013 | Sen | H01R 13/639 439/347 |

* cited by examiner

*Primary Examiner* — Phuongchi T Nguyen
(74) *Attorney, Agent, or Firm* — Songfong T. Wang; Yang & Wang, P.C.

(57) ABSTRACT

A clip connector joins a cable from an earpiece or earpiece accessory, and, from an opposite end, clips on to a socket region of a two-way radio. A housing includes a clip end, a cable end, an outer side, and a mounting side. The cable end has a cable socket. The mounting side has a tab for fastening. The mounting side also has a pair of spaced-apart protrusions for fastening. A head comprises a head clip end, a head pivot end, a head outer side, and a head mounting side. The head pivot end pivotally attaches to the clip end of the housing. The head mounting side includes a head opening having a peripheral ridge. The connection is formed by inserting a tab into a tab reception slot in the socket region; and from an opposite end, pivotally buckling a spring-loaded head onto a flange of the socket region.

20 Claims, 10 Drawing Sheets

PORTABLE COMMUNICATION DEVICE CLIP CONNECTOR

FIELD OF THE INVENTION

The present invention relates generally to a clip connector for connecting a cable to a portable communication device. More so, a clip-style connector for connecting a cable from an earpiece or earpiece accessory to a two-way radio is adapted to clip on to a socket region of the two-way radio by inserting a tab into a tab reception slot of the socket region, and from an opposite end, pivotally fastening a spring-loaded clip head onto a flange in the socket region of the two-way radio.

BACKGROUND OF THE INVENTION

Typically, two way radios allow users the ability to wirelessly communicate on a small network. Most two way radios use various channels or frequencies for communication. Monitoring of more than one channel allows a user to communicate with a plurality of people for a variety of purposes. In a security environment, for instance, channel 1 may be used to communicate about and monitor emergency conditions. Channel 2 may be used to communicate about and monitor major security threats. Channel 3 may be used to communicate about and monitor minor security threats.

It is known that headsets are used in variety of applications to facilitate one- or two-way audio communications between users and/or devices. For example, many aircraft pilots wear headsets to enable them to communicate via two-way radio with other aircraft and air-traffic controllers as well as via a public-address system with passengers. Additionally, some headsets are worn to facilitate hands-free usage of mobile telephones, while others facilitate private listening to devices, such as computers, stereos, disk players, etc.

Generally, the rapid advance of technology continues to drive the proliferation of different types of cables and connectors for the two-way radios. As new standards are promulgated and adopted, so new cables are designed and sold. However, any cable connection is susceptible to events that may dislodge it and thereby disrupt its intended purpose. Such events may also damage the cable or its socket, or potentially degrade their functionality. Furthermore, even if no damage occurs, the user must go through the hassle of reconnecting the cable. If the location of the connection is easily accessible, this may be a minor inconvenience.

Accessory connectors are often used in conjunction with portable communication devices, such as two-way radios and the like. Many of today's accessory connectors utilize a screw-type attachment mechanism in which a screw and insert-nut are used for mounting and retaining the accessory to the device. The user interface on such connectors may vary from individual to individual in terms of the amount of torque being applied to the screw and the time needed to screw and unscrew the connector to and from the device. Depending on the environment, the screw-type connector may also face issues with corrosion and susceptibility to electrostatic discharge.

To deal with this problem, some cable connector designs include mechanisms to help prevent their disconnection. For example, a typical serial port connection for a computer is secured by a couple of screws located adjacent to the connector. However, many cable connector types, such as USB and HDMI, do not have adequate security for preventing dislodgement or poor coupling and pin connections. These connectors are held in place by little more than the friction and rigidity of the pin-to-socket connection and connector shell portions surrounding the pins and sockets, all of which having varying and depletable degrees of inference fit.

In operational use of two-way radios, a user speaks directly into the microphone of the radio. Additionally, a speaker on the radio emits sound for the user to listen. The two-way radio may be attached to the chest, hips, arms, or possibly at a further distance from the user. However, from these attached body positions, the user may have problems speaking or listening on the two-way radio without contorting the neck to move closer, or using the hands to move the two-way radio to the mouth.

Consequently, access for speaking into the two-way radio may be problematic and slow. One solution is to wear an earpiece or earpiece accessory. The earpiece or earpiece accessory positions on the head and provides easier access for speaking and listening. Generally, a cable extends from the earpiece or earpiece accessory, and must be connected to the communication device.

Other proposals have involved for connectors between two-way radios and earpiece or earpiece accessorys. The problem with these devices is that they do not provide a robust, easily detachable connector that can be used with gloves and in emergency situations. The present invention forms this connection through an easy to use clip-style connecting mechanism.

Thus, an unaddressed need exists in the industry to address the aforementioned deficiencies and inadequacies. Even though the above cited methods for two-way radio connectors meets some of the needs of the market, a pivotal connector that is configured to pivotally connect and disconnect an earpiece or earpiece accessory cable and a two-way radio is still desired.

SUMMARY OF THE INVENTION

The present invention is directed to a clip connector that forms a clipping mechanism for clipping and unclipping the connector to and from a communication device in accordance with the various embodiments. In one embodiment, the connector is configured to pivotally connect and disconnect a cable that attaches an earpiece or earpiece accessory, to a two-way radio.

The connector is adapted to join from one end with a cable from an earpiece or earpiece accessory, and from an opposite end, clip on to a socket region of the two-way radio. The connector is configured to connect the cable and the two-way radio by inserting a tab into a tab reception slot of the socket region of the two-way radio; and from an opposite end, pivotally buckling a spring-loaded head onto a flange of the socket region. The spring-loaded, pivoting motion of the head provides an easy and robust connection.

The clip connector serves as an easy clip-on type junction to connect a cable from an earpiece or earpiece accessory to a communication device. The communication device may include, without limitation, a walkie-talkie and a portable radio. The cable may be operatively connected to an earpiece or earpiece accessory, a speaker, an earpiece, and a remote data device. The capacity to clip, rather than to latch, screw, or frictionally engage the connector to the communication device expedites connecting and disconnecting the cable from the communication device.

In some embodiments, the connector comprises a housing. The housing is defined by a clip end, a cable end, an outer side, and a mounting side. The housing is generally elongated and substantially matches a socket region of the communication device. The cable end of the housing has a cable socket that is configured to enable reception of a cable from an earpiece or earpiece accessory.

The mounting side of the housing has a tab. The tab is disposed proximally to the cable end of the housing. The tab may be disposed at an angle, so as to create greater leverage when inserted into the communication device. The tab is configured to enable insertion into a tab reception slot in the socket region of the communication device. The mating disposition between the tab and the tab slot at least partially fastens the connector to the communication device.

The mounting side further includes a pair of spaced-apart protrusions. The pair of spaced-apart protrusions are disposed proximally to the clip end of the housing, extending generally perpendicular to the mounting side of the housing. Similar to the tab, the pair of spaced-apart protrusions are configured to enable insertion into a pair of spaced-apart apertures in the socket region of the communication device. The mating disposition between the protrusions and the apertures at least partially fastens the connector to the communication device.

The mounting side further having at least one pin. The at least one pin may include a plurality of metal conducting leads that form an electrical connection with pin holes in the socket region of the communication device.

In some embodiments, the connector may include a head that pivotally joins the housing. The head works in conjunction with the housing to form a secure, pivotally detachable connection to the communication device. In some embodiments, the head may be defined by a head clip end, a head pivot end, a head outer side, and a head mounting side.

The head pivot end is configured to pivotally attach to the clip end of the housing. The head moves between a clip-on position and a clip-off position. The clip-on position enables fastening to the communication device. The clip-off position enables pivotal detachment form the communication device. In one embodiment, the head is spring-loaded and biased towards the clip-on position. An axle may join the head to the housing. In one embodiment, the axle is configured to pivotally join the clip end of the housing to the head pivot end of the head.

The head mounting side of the head may include a head opening that extends along the length of the head mounting side. The head opening is defined by a ridge. The ridge may be a substantially V-shaped extension that extends around the perimeter of the head opening. The ridge is configured to enable buckling onto a flange on the socket region. The buckling disposition between the ridge and the flange at least partially fastens the connector to the communication device.

In operation, a method for connecting a cable to a communication device with a clip connector comprises: providing a clip connector; joining a cable to a cable end of a housing on the clip connector; positioning the clip connector proximally to a communication device, such that a head clip end of a head is aligned with a flange from the communication device, and a clip end of the housing is aligned with a tab reception slot from the communication device.

The method further includes inserting a tab from a mounting side of the housing into the tab reception slot of the communication device; inserting a pair of spaced-apart protrusions from the mounting side of the housing into a pair of spaced-apart apertures in the communication device; pivoting the head to a clip-off position; engaging a ridge from the head mounting side with the flange from the communication device; and releasing the head to the clip-on position, wherein the ridge, the tab, and the pair of spaced-apart protrusions fasten the clip connector to the communication device.

One objective of the present invention is to provide a clip-style connector that expedites connecting an earpiece or earpiece accessory to a two-way radio.

Another objective is to expedite connecting a cable to a two-way radio.

Another objective is to provide a spring-loaded head that is biased towards a clip-on position.

Yet another objective is to provide at least one pin on the connector that mates with similarly aligned and numbered pins on the socket region of the communication device.

Yet another objective is to negate the need to contort the neck to speak or listen into a two-way radio by wearing an earpiece or earpiece accessory and joining the cable to the communication device through the connector.

Yet another objective is to manufacture the connector to adapt universally to multiple types and sizes of communication devices and cables.

Yet another objective is to provide an easy to clip on and off connector for two-way radios.

Other systems, devices, methods, features, and advantages will be or become apparent to one with skill in the art upon examination of the following drawings and detailed description. It is intended that all such additional systems, methods, features, and advantages be included within this description, be within the scope of the present disclosure, and be protected by the accompanying claims and drawings.

BRIEF DESCRIPTION OF THE DRAWINGS

The invention will now be described, by way of example, with reference to the accompanying drawings, in which.

DETAILED DESCRIPTION OF THE INVENTION

Figure 1:
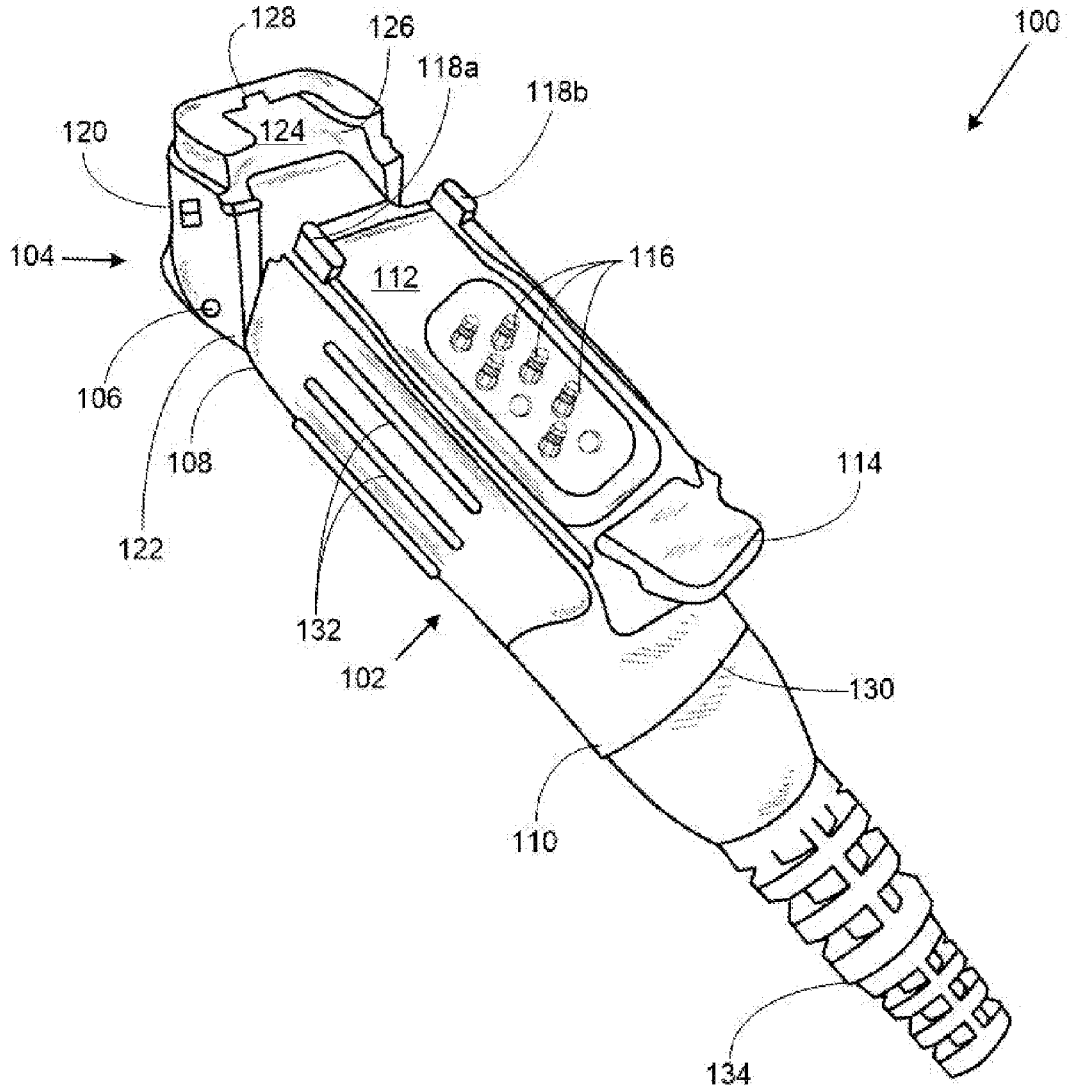
FIG. 1 illustrates a bottom perspective view of an exemplary clip connector, in accordance with an embodiment of the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "first," "second," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

At the outset, it should be clearly understood that like reference numerals are intended to identify the same structural elements, portions, or surfaces consistently throughout the several drawing figures, as may be further described or explained by the entire written specification of which this detailed description is an integral part. The drawings are intended to be read together with the specification and are to be construed as a portion of the entire "written description" of this invention as required by 35 U.S.C. §112.

In one embodiment of the present invention, presented in FIGS. 1-16, a clip connector 100, hereinafter "connector", is configured to provide a clipping mechanism for clipping and unclipping the connector 100 to and from a communication device 148 in accordance with the various embodiments. In one embodiment, the connector 100 is configured to pivotally connect and disconnect a cable that attaches an earpiece or earpiece accessory, to a two-way radio.

In one embodiment, the connector 100 is configured to connect the cable 146 and the communication device 148 by inserting a tab 114 into a tab reception slot 152 of the socket region 150 of the communication device 148; and from an opposite end, pivotally buckling a spring-loaded head onto a flange of the socket region 150. The spring-loaded, pivoting motion of the head 104 provides an easy and robust connection.

In some embodiments, the connector 100 serves as an easy, clipping mechanism to connect a cable 146 from an earpiece or earpiece accessory to a communication device 148. The communication device 148 may include, without limitation, a two-way radio, a walkie-talkie, and a portable radio. The cable 146 may be operatively connected to an earpiece or earpiece accessory, a speaker, an earpiece, and a remote data device. The capacity to clip, rather than to latch, screw, or frictionally engage the connector 100 to the communication device 148 expedites connecting and disconnecting the cable 146 from the communication device 148. Also, there is less wear and tear on the connector 100 through the simple clipping motion.

Those skilled in the art will recognize that in operational use of two-way radios, a user speaks directly into the microphone of the radio. Additionally, a speaker on the radio emits sound for the user to listen. The two-way radio may be attached to the chest, hips, arms, or possibly at a further distance from the user. However, from these attached body positions, the user may have problems speaking or listening on the two-way radio without contorting the neck to move closer, or using the hands to move the two-way radio to the mouth. Consequently, access for speaking into the two-way radio may be problematic and slow. One solution is to wear an earpiece or earpiece accessory. The earpiece or earpiece accessory positions on the head area of a user and provides easier access for speaking and listening. Generally, a cable 146 extends from the earpiece or earpiece accessory, and must be connected to the communication device 148. The present invention forms this connection through an easy to use clip-style connecting mechanism.

It is also significant to note that, while the connector 100 chiefly serves to connect a two-way radio to a cable 146 from an earpiece or earpiece accessory, the connector 100 may also be operable with any variety of electronic communication devices that requires robust, reliable and quick release engagement.

In one possible embodiment, the connector 100 may have a contour that forms tactile feedback. The tactile feedback is formed in accordance with the various embodiments, facilitates the attachment and detachment of the connector 100 to and from the communication device 148. In one embodiment, the tactile feedback includes a plurality of rubber strips 132 that extend along the length of the housing 102 and the head 104.

Thus, the quick release engagement and the tactile feedback features offered by the connector 100 are especially effective for emergency personnel. For example, a user wearing heavy gloves, or working in an area with little or no illumination, or other environmental condition, may easily pivot a head 104 of the connector 100 to a clip-off position 142 for fast detachment, or release the head 104 of the connector 100 to the biased clip-on position 140 to reconnect.

As referenced in FIG. 1, the connector 100 comprises a housing 102. The housing 102 is generally elongated and has a generally channel-shaped configuration. The housing 102 is defined by a clip end 108, a cable end 110, an outer side 136, and a mounting side 112. The cable end 110 of the housing 102 has a cable socket 130 that is configured to enable reception of a cable 146 from an earpiece or earpiece accessory. In one possible embodiment, the cable 146 utilizes a strain relief member 134 to reduce tensions applied between the cable 146 and the cable socket 130.

Figure 2:
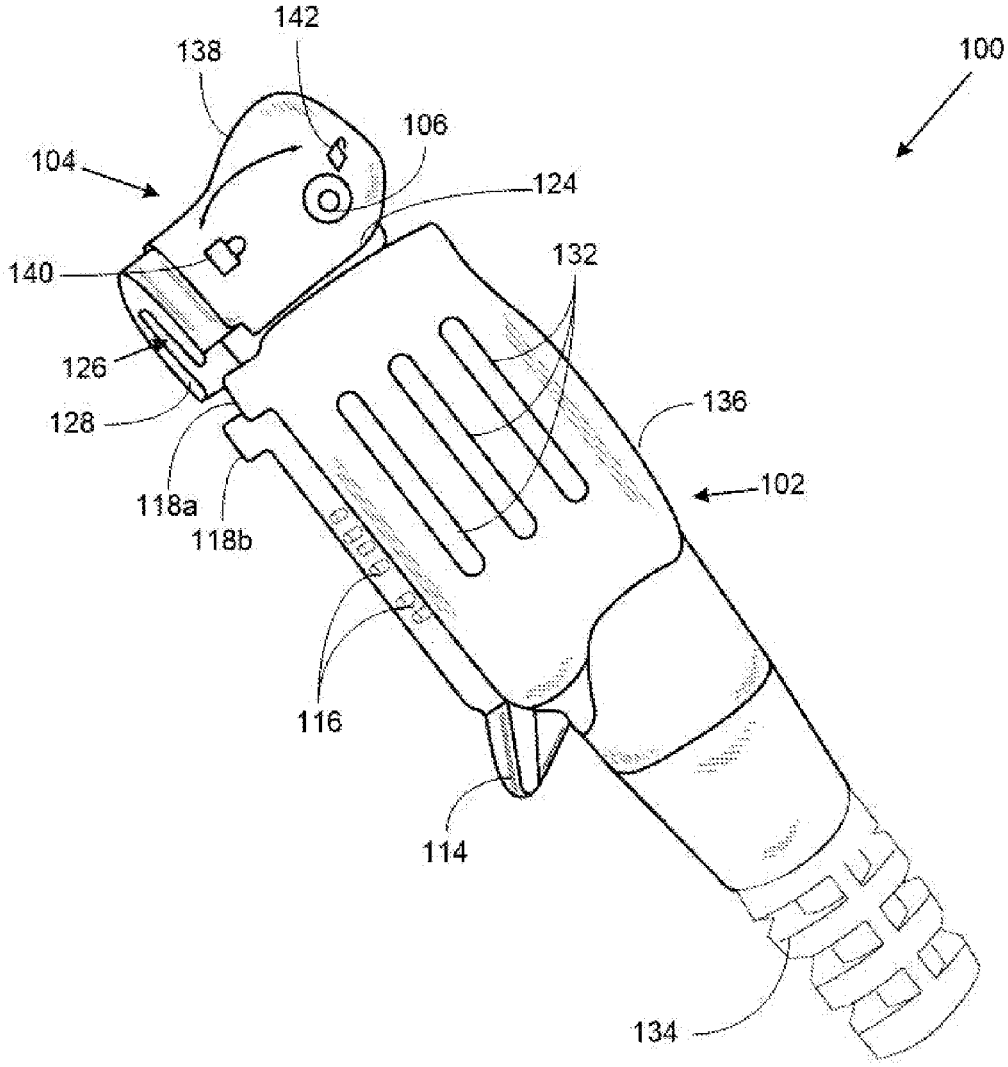
FIG. 2 illustrates a side perspective view of the clip connector, in accordance with an embodiment of the present invention.

Turning now to FIG. 2, the mounting side 112 of the housing 102 substantially matches a socket region 150 of the communication device 148 for proper alignment and connection. The mounting side 112 comprises a tab 114, disposed proximally to the cable end 110 of the housing 102. The tab 114 may be disposed at an angle, so as to create greater leverage when inserted into the communication device 148. The tab 114 is configured to insert into a tab reception slot 152 in the socket region 150 of the communication device 148. The mating disposition between the tab 114 and the tab reception slot 152 at least partially fastens the connector 100 to the communication device 148.

The mounting side 112 further includes a pair of spaced-apart protrusions 118*a-b*. The pair of spaced-apart protrusions 118*a-b* are disposed proximally to the clip end 108 of the housing 102, extending generally perpendicular to the mounting side 112 of the housing 102. Similar to the tab 114, the pair of spaced-apart protrusions 118*a-b* are configured to insert into a pair of spaced-apart apertures 154*a-b* in the socket region 150 of the communication device 148. The mating disposition between the protrusions 118*a-b* and the apertures 154*a-b* at least partially fastens the connector 100 to the communication device 148.

The mounting side 112 further having at least one pin 116. The at least one pin 116 may include a plurality of metal conducting leads that form an electrical connection with the socket region 150 of the communication device 148. The pins may mate with similarly configured pin holes in the socket region 150 of the communication device 148 to carry electricity and data therebetween.

Figure 3:
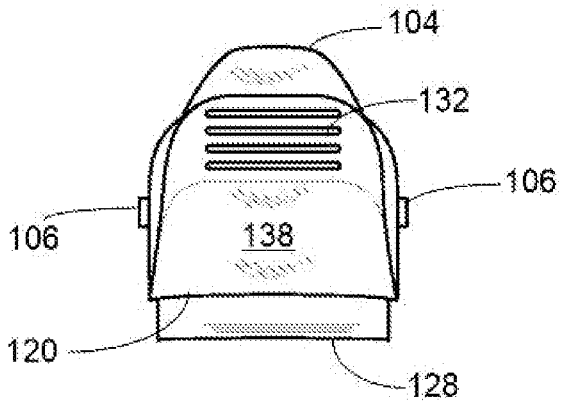
FIG. 3 illustrates a frontal view of the clip connector, in accordance with an embodiment of the present invention.
Figure 4:
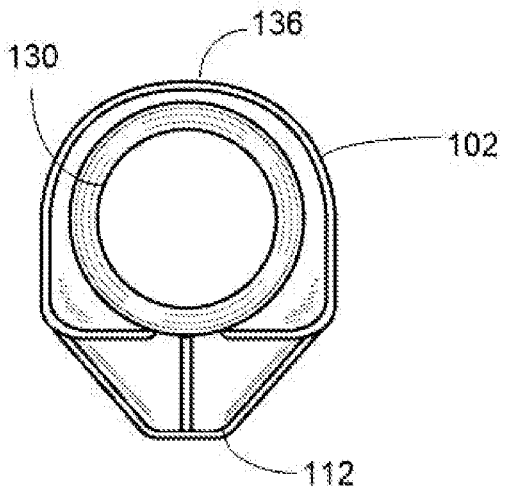
FIG. 4 illustrates a rear view of the clip connector, in accordance with an embodiment of the present invention.

As illustrated in FIG. 3, the connector 100 may include a head 104 that pivotally joins the housing 102. The head 104 works in conjunction with the housing 102 to form a secure, pivotally detachable connection with the communication device 148. The head 104 may have a generally rounded contour with a series of tactile feedback rubber strips 132 for providing a grip to pivot the head 104 accordingly. For example, the head 104 may be forced to the clip-off position 142, and then released to the clip-on position 140 through manipulation of the head 104 at the rubber strips 132. In some embodiments, the head 104 may be defined by a head clip end 120, a head pivot end 122, a head outer side 138, and a head mounting side 124 (FIG. 4).

Figure 5:
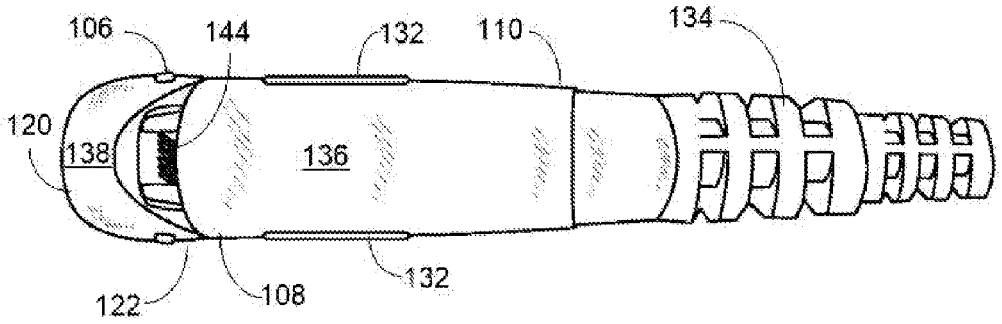
FIG. 5 illustrates a top view of the clip connector, in accordance with an embodiment of the present invention.

As referenced in FIG. 5, the head pivot end 122 is configured to pivotally attach to the clip end 108 of the housing 102. The head 104 moves between a clip-on position 140 and a clip-off position 142. The clip-on position 140 enables fastening to the communication device 148. The clip-off position 142 enables pivotal detachment form the communication device 148. In one embodiment, the head 104 is spring-loaded with a spring 144 and biased towards the clip-on position 140. Thus, by releasing the head 104 to its natural position, the connector 100 pivotally buckles onto the communication device 148.

An axle 106 may join the head 104 to the housing 102. In one embodiment, the axle 106 is configured to pivotally join the clip end 108 of the housing 102 to the head pivot end 122 of the head 104. The axle 106 may include an elongated rod that passes through a channel that runs through the head picot end 122 and the clip end 108.

Figure 6:
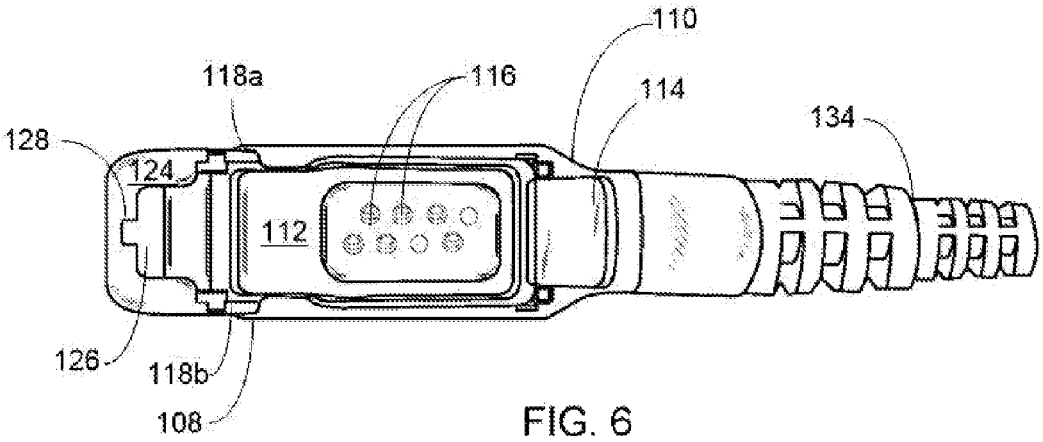
FIG. 6 illustrates a bottom view of the clip connector, in accordance with an embodiment of the present invention.
Figure 7:
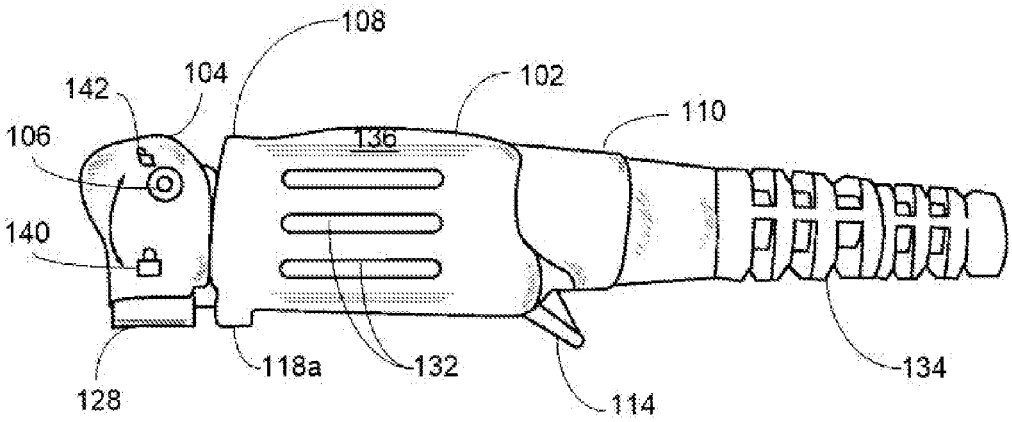
FIG. 7 illustrates an elevated side view of the clip connector, in accordance with an embodiment of the present invention.

Turning now to FIG. 6, the head mounting side 124 of the head 104 may include a head opening 126 that extends along the length of the head mounting side 124. The head opening 126 is defined by a ridge 128. The ridge 128 may be a substantially V-shaped extension that runs around the perimeter of the head opening 126. The ridge 128 is configured to enable buckling onto a flange 156 in the socket region 150 (FIG. 7). The buckling disposition between the ridge 128 and the flange 156 at least partially fastens the connector 100 to the communication device 148.

The housing 102 and the head 104 may be constructed of unitarily molded piece parts inter-operably coupled together, in a manner to be described herein, without the use of springs or screws. Suitable materials for fabrication may include, without limitation, rigid polymers, polyvinylchloride, polyurethane, various plastics, resins, and metals. In one embodiment, injection-molding processing may be used to form the housing 102 and the head 104.

Figure 16:
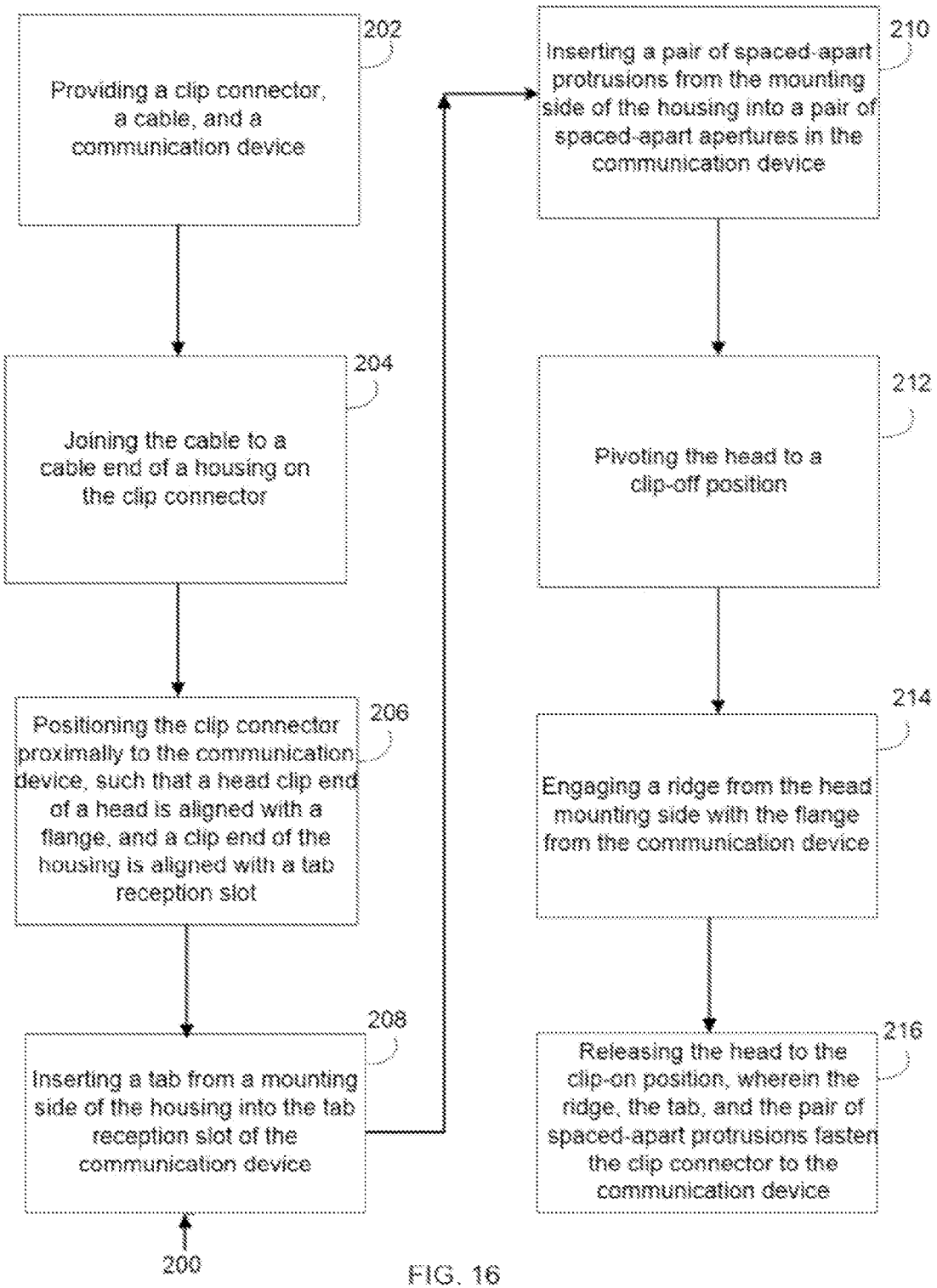
FIG. 16 illustrates a flowchart diagram of an exemplary method for connecting a com Like reference numerals refer to like parts throughout the various views of the drawings.

FIG. 16 illustrates a flowchart diagram of an exemplary method 200 for pivotally connecting a cable 146 to a communication device 148 with a clip connector 100. The method 200 may include a clipping mechanism for clipping and unclipping the connector 100 to and from a communication device 148. In one embodiment, the connector 100 is configured to pivotally connect and disconnect a cable 146 of an earpiece or earpiece accessory cable to a two-way radio.

Figure 8:
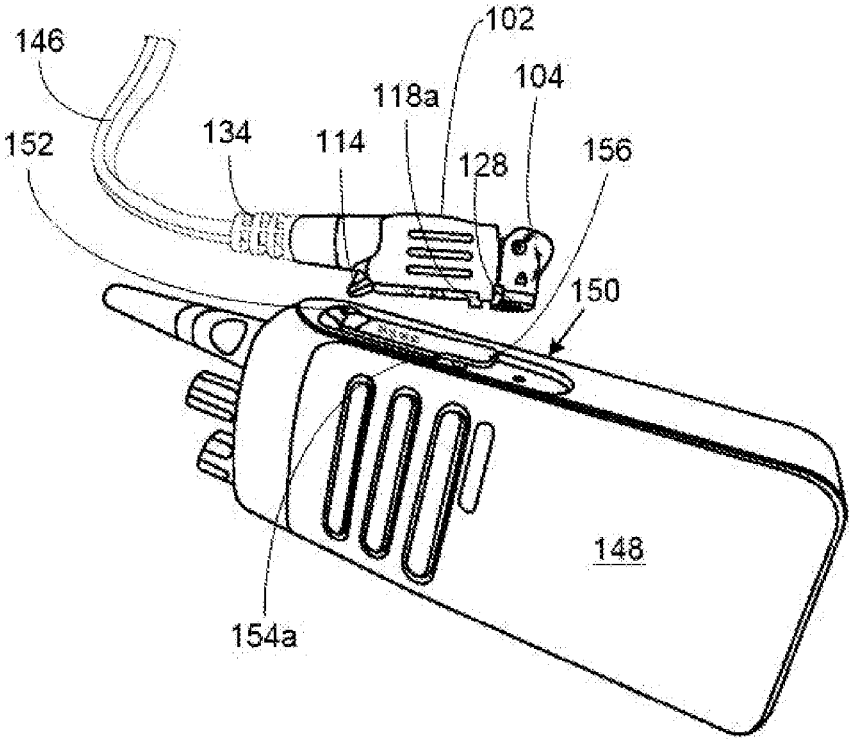
FIG. 8 illustrates a perspective view of the clip connector in alignment with an exemplary communication device, in accordance with an embodiment of the present invention.

The method 200 may include an initial Step 202 of providing a clip connector 100, a cable 146, and a communication device 148. The clip connector 100 may include a pivoting mechanism for easy and robust attachment and detachment of a cable 146 from an earpiece or earpiece accessory to a communication device 148, such as a two-way radio. FIG. 8 illustrates a perspective view of the clip connector 100 in alignment with the communication device 148 in preparation for connecting.

In some embodiments, the method 200 may further comprise a Step 204 of joining the cable 146 to a cable end 110 of a housing 102 on the clip connector 100. The cable 146 may include a data and/or power cable that connects directly from the earpiece or earpiece accessory to a cable socket 130 on the cable end 110 of the housing 102.

Figure 9:
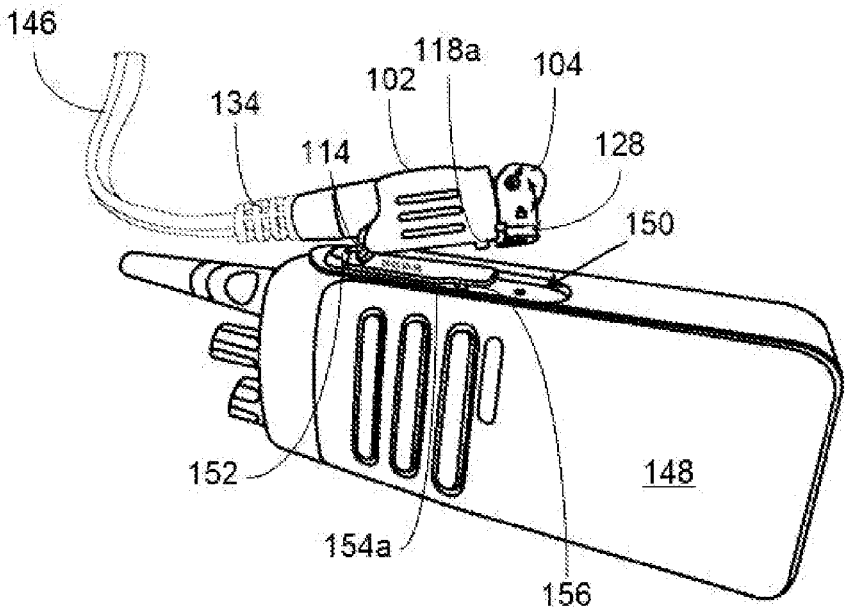
FIG. 9 illustrates a perspective view of the clip connector in alignment with an exemplary tab engaging an exemplary tab reception slot, in accordance with an embodiment of the present invention.
Figure 10:
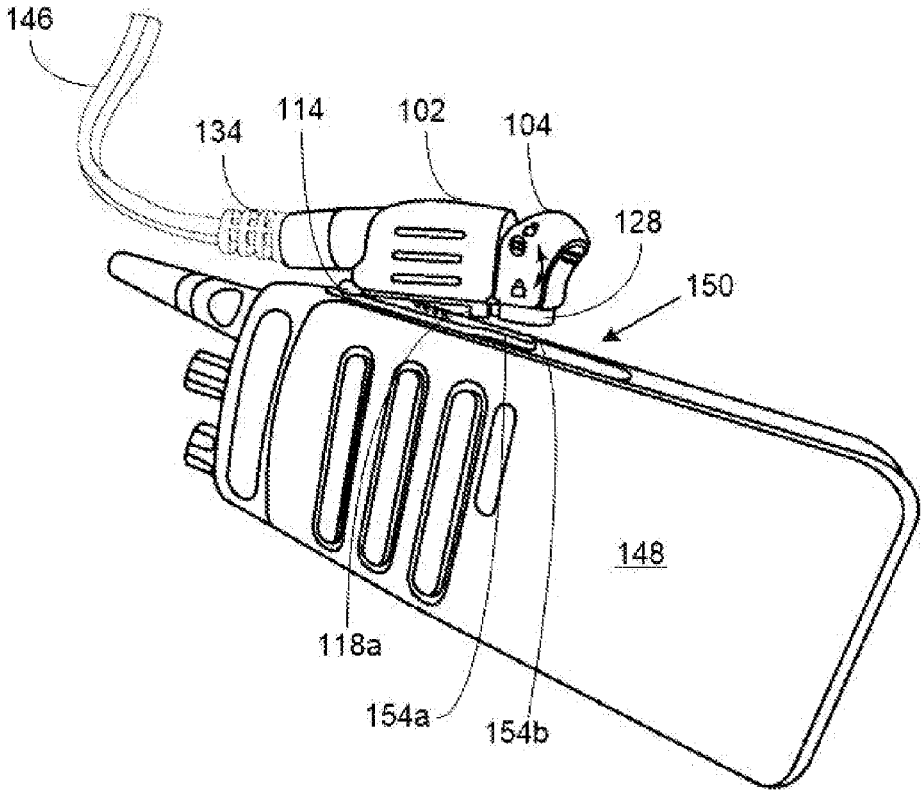
FIG. 10 illustrates a perspective view of the clip connector in alignment with an exemplary pair of spaced-apart apertures engaging an exemplary pair of spaced-apart apertures, in accordance with an embodiment of the present invention.

As shown in FIG. 9, a Step 206 includes positioning the clip connector 100 proximally to the communication device 148, such that a head clip end 120 of the head 104 is aligned with a flange 156 from the communication device 148; and a clip end 108 of the housing 102 is aligned with a tab reception slot 152 from the communication device 148. In some embodiments, a Step 208 comprises inserting a tab 114 from a mounting side 112 of the housing 102 into the tab reception slot 152 of the communication device 148 (FIG. 10).

Figure 11:
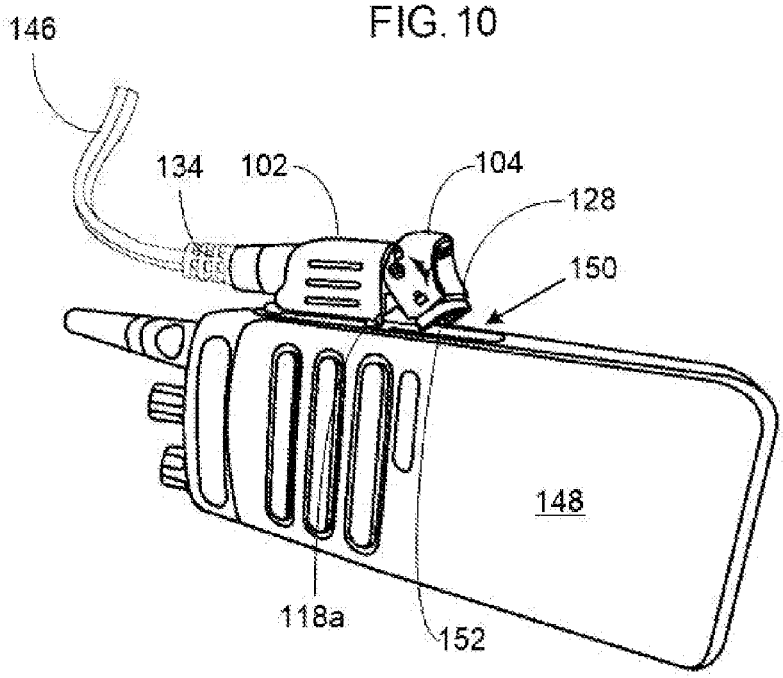
FIG. 11 illustrates a perspective view of the clip connector moving to the clip-off position, in accordance with an embodiment of the present invention.

A Step 210 includes inserting a pair of spaced-apart protrusions 118*a-b* from the mounting side 112 of the housing 102 into a pair of spaced-apart apertures 154*a-b* in the communication device 148. In some embodiments, a Step 212 may include pivoting the head 104 to a clip-off position 142. FIG. 11 illustrates a perspective view of the clip connector 100 moving to the clip-off position 142.

Figure 12:
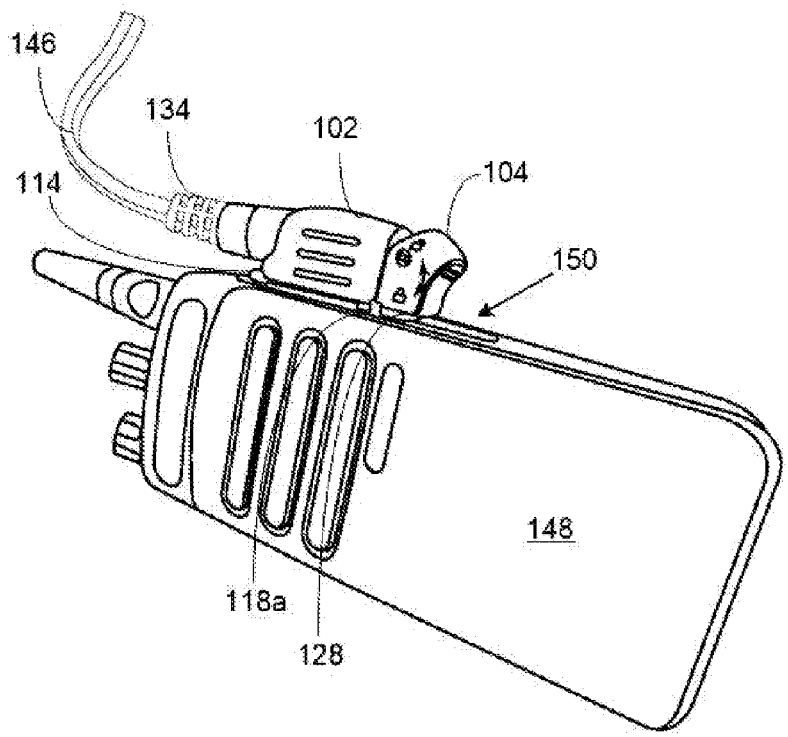
FIG. 12 illustrates a perspective view of the clip connector in the clip-on position and fully connected to the communication device, in accordance with an embodiment of the present invention.

A Step 214 comprises engaging a ridge 128 from the head mounting side 124 with the flange 156 from the communication device 148. In this configuration, the connector 100 is fully connected to the communication device 148. A final Step 216 includes releasing the head 104 to the clip-on position 140, wherein the ridge 128, the tab 114, and the pair of spaced-apart protrusions 118*a-b* fasten the clip connector 100 to the communication device 148. FIG. 12 illustrates a perspective view of the clip connector 100 in the clip-on position 140 and fully connected to the communication device 148.

Figure 13:
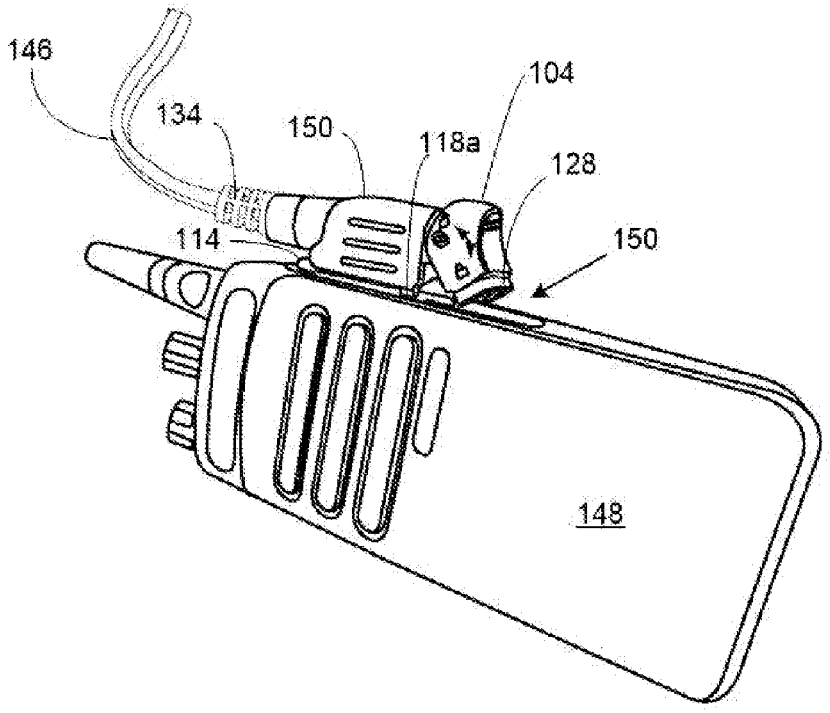
FIG. 13 illustrates a perspective view of the clip connector moving to the clip-off position, in accordance with an embodiment of the present invention.

Detaching the connector 100 from the communication device 148 involves substantially the opposite steps. Initially, the head 104 is pivoted to the clip-off position 142. FIG. 13 illustrates a perspective view of the clip connector 100 moving to the clip-off position 142.

The head 104 may then be pulled along the length of the housing 102 to disengage the tab 114 and the protrusions

Figure 14:
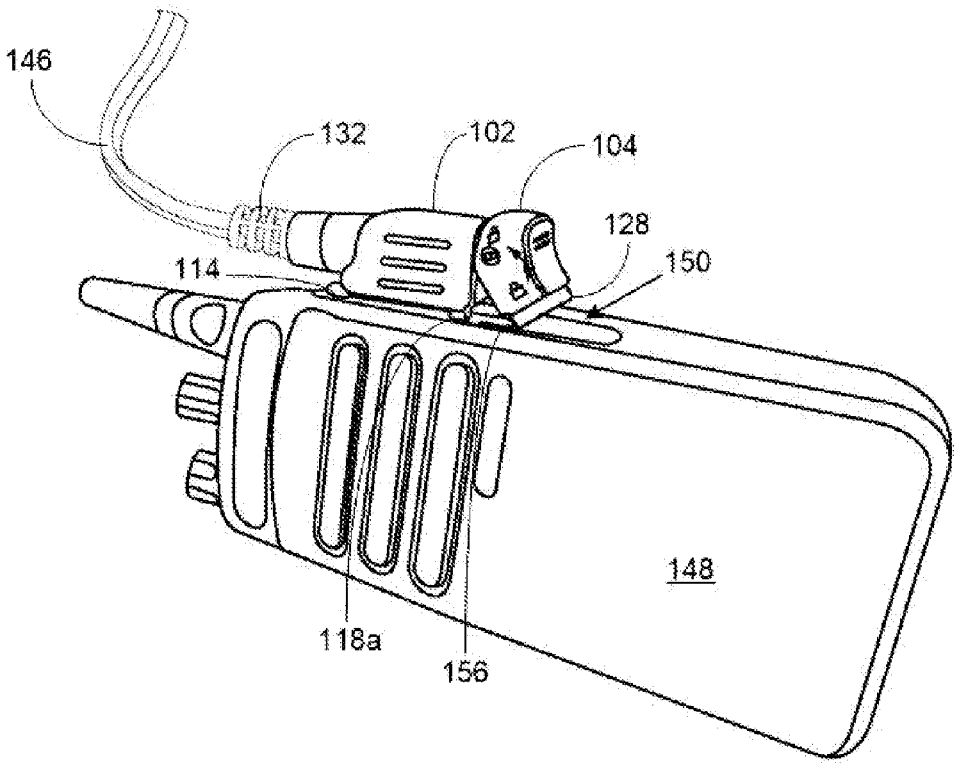
FIG. 14 illustrates a perspective view of the clip connector disengaging from the communication device, in accordance with an embodiment of the present invention.
Figure 15:
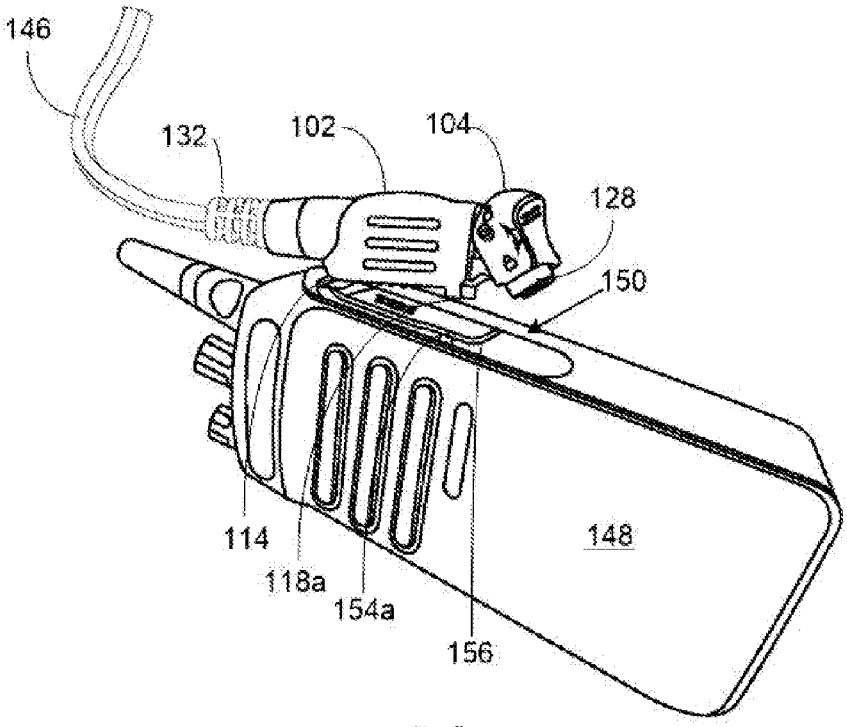
FIG. 15 illustrates a perspective view of the clip connector in alignment fully disengaged from the communication device, in accordance with an embodiment of the present invention.

118*a-b*. FIG. 14 illustrates a perspective view of the clip connector 100 disengaging from the communication device 148. In this illustration, the head 104 is pulled longitudinally along the housing 102 to detach the tab 114 from the tab 114 reception slot 152, and to remove the spaced-apart protrusions 118*a-b* form the spaced-apart apertures 154*a-b*. Finally, FIG. 15 illustrates a perspective view of the connector 100 fully disengaged from the communication device 148.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

We claim:

1. A clip connector for connecting a cable to a communication device, the connector comprising:

a housing, the housing defined by a clip end, a cable end, an outer side, and a mounting side, the cable end having a cable socket, the mounting side having a tab, the tab disposed proximally to the cable end of the housing, the mounting side further having a pair of spaced-apart protrusions, the pair of spaced-apart protrusions disposed proximally to the clip end of the housing; and a head, the head defined by a head clip end, a head pivot end, a head outer side, and a head mounting side, the head pivot end configured to pivotally attach to the clip end of the housing, the head mounting side having a head opening, the head opening defined by a ridge.

2. The connector of claim 1, wherein the housing is generally elongated.

3. The connector of claim 1, wherein the mounting side of the housing is defined by at least one pin.

4. The connector of claim 1, wherein the tab from the mounting side of the housing is disposed at an angle.

5. The connector of claim 1, wherein the head is configured to pivot between a clip-on position and a clip-off position.

6. The connector of claim 1, wherein the head is spring-loaded head and biased towards the clip-on position.

7. The connector of claim 1, wherein the ridge on the head mounting side is configured to enable buckling onto a flange on the socket region.

8. The connector of claim 1, further including an axle.

9. The connector of claim 8, wherein the axle pivotally joins the clip end of the housing to the head pivot end of the head.

10. The connector of claim 1, wherein the connector is configured to enable a connection between a communication device and a cable.

11. The connector of claim 10, wherein the connector is configured to enable mating with a socket region of the communication device.

12. The connector of claim 11, wherein the communication device is a two-way radio.

13. The connector of claim 12, wherein the cable is disposed to extend from an earpiece or earpiece accessory to the cable socket of the housing.

14. The connector of claim 13, wherein the tab is configured to enable insertion into a tab reception slot in the socket region of the communication device.

15. The connector of claim 14, wherein the pair of spaced-apart protrusions are configured to enable insertion into a pair of spaced-apart apertures in the socket region of the communication device.

16. A clip connector for connecting a cable to a communication device, the connector comprising:

a housing, the housing defined by a clip end, a cable end, an outer side, and a mounting side, the cable end having a cable socket, the mounting side having a tab, the tab disposed proximally to the cable end of the housing, the mounting side further having a pair of spaced-apart protrusions, the pair of spaced-apart protrusions disposed proximally to the clip end of the housing, the mounting side further having at least one pin;

a head, the head defined by a head clip end, a head pivot end, a head outer side, and a head mounting side, the head pivot end configured to pivotally attach to the clip end of the housing, the head mounting side having a head opening, the head opening defined by a ridge; and an axle, the axle configured to pivotally join the clip end of the housing to the head pivot end of the head.

17. The connector of claim 16, wherein the connector is configured to enable a connection between a communication device and a cable.

18. The connector of claim 16, wherein the tab from the mounting side of the housing is disposed at an angle.

19. The connector of claim 16, wherein the tab is configured to enable insertion into a tab reception slot in the socket region of the communication device.

20. A method for pivotally connecting a cable to a communication device with a clip connector, the method comprising:

providing a clip connector, a cable, and a communication device;

joining the cable to a cable end of a housing on the clip connector;

positioning the clip connector proximally to the communication device, such that a head clip end of a head is aligned with a flange from the communication device, and a clip end of the housing is aligned with a tab reception slot from the communication device;

inserting a tab from a mounting side of the housing into the tab reception slot of the communication device;

inserting a pair of spaced-apart protrusions from the mounting side of the housing into a pair of spaced-apart apertures in the communication device;

pivoting the head to a clip-off position;

engaging a ridge from the head mounting side with the flange from the communication device; and releasing the head to the clip-on position, wherein the ridge, the tab, and the pair of spaced-apart protrusions fasten the clip connector to the communication device.

* * * * *